United States Patent [19]

Younts

[11] 4,423,868

[45] Jan. 3, 1984

[54] PROTECTIVE DEVICE FOR USE ON A BASEBALL BAT

[76] Inventor: Richard B. Younts, 2706 Elmore Dr., Springfield, Ohio 45505

[21] Appl. No.: 326,827

[22] Filed: Dec. 2, 1981

[51] Int. Cl.[3] ..... A63B 59/06

[52] U.S. Cl. ..... 273/72 R; 30/295

[58] Field of Search ..... 273/73 J, 72, 75, 67 DA, 273/84 R, 67 R, 67 DB; 30/295, 286, 165

[56] References Cited

U.S. PATENT DOCUMENTS 4,214,751 7/1980 Simpson ..... 273/26 B

FOREIGN PATENT DOCUMENTS 282370 2/1931 Italy ..... 30/295

*Primary Examiner*—Anton O. Oechsle
*Assistant Examiner*—Matthew Schneider
*Attorney, Agent, or Firm*—Gregory A. Stobbs

[57] ABSTRACT

The knuckle guard has a shield adapted for removable or permanent attachment to the grip portion of a baseball bat. An elongated, rigid strap is attached to the periphery of the shield and also to the bat, spanning the batter's hands to shield them from being struck by an inside pitch.

2 Claims, 3 Drawing Figures

PROTECTIVE DEVICE FOR USE ON A BASEBALL BAT

BACKGROUND OF THE INVENTION

1. Field of the Invention

This invention relates generally to protective sports equipment, and more particularly to a device for protecting the hands and knuckles of a batter from being struck by a baseball or softball.

2. Description of the Prior Art

As many baseball players have experienced, there is a certain risk of having the hands and knuckles struck and injured by a baseball. This is especially true when the player is at bat. A fast pitch can easily carry sufficient momentum to seriously injure the carpal, metacarpal and philanges bones of the hand. Even at lesser speeds, being struck by a pitch can be quite painful.

While experienced professional players and seasoned amatures can usually rely on quick reflexes to avoid being struck; even the quickest are occasionally caught off guard. Moreover, young children who have not yet developed quick reflexes are struck more frequently. Often these children react to the traumatic experience by shying away from the pitch thereafter, or even away from the batter's box entirely.

SUMMARY OF THE INVENTION

The present invention sufficiently lessens the risk of painful injury to a batter's hands and knuckles caused by the pitched baseball, softball, or the like. The invention comprises an inexpensive protective device which may be readily attached to and detached from a baseball bat, or manufactured as an integral part thereof. The device includes an elongated body which shields the hands and knuckles from the path of the pitched ball. A cup-shaped portion attached to the elongated body at one end thereof is adapted for removable or permanent attachment to the grip of the bat. An additional attachment means is connected to the opposite end of the elongated body for removable attachment to the bat.

For a more detailed understanding of the invention, reference is made to the following specification and the accompanying drawings.

DESCRIPTION OF THE PREFERRED EMBODIMENTS

Figure 1:
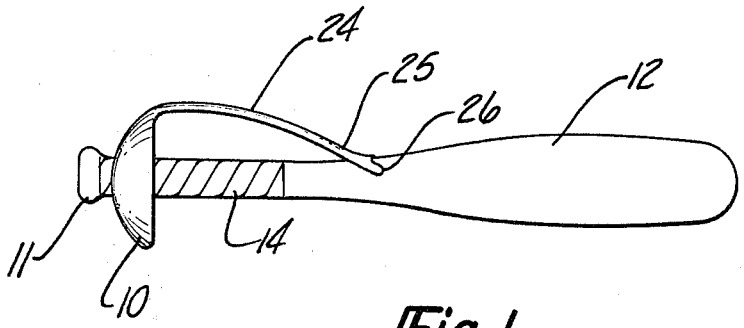
FIG. 1 is a side view of a first embodiment of the infention shown attached to a bat.
Figure 2:
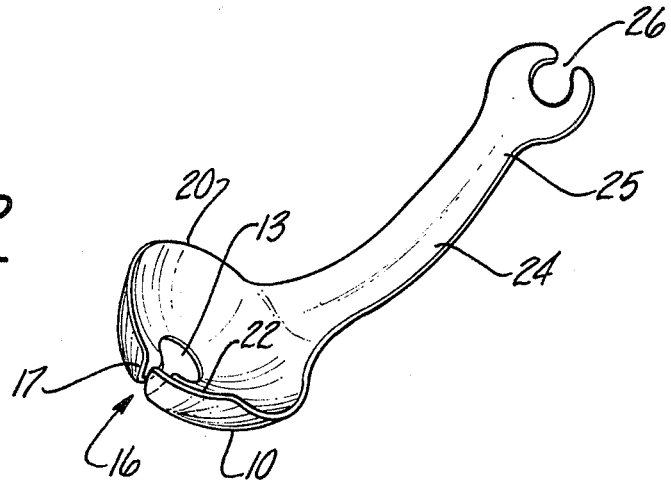
FIG. 2 is another perspective view of the embodiment of FIG. 1.

Referring to FIGS. 1 and 2 of the drawings, the presently preferred embodiment of the invention comprises a generally paraboloidal or cup shaped first body portion 10. The first body portion 10 may be fashioned as an integral part of the bat 12, or it may be adapted for removable attachment thereto. In either case the first body portion 10 is preferably located near the knob 11 of the bat 12. In the removable embodiment the first body portion 10 has a generally circular opening 13 in the botton of the cup which is adapted to substantially encircle the grip portion 14 of the bat 12. The first body portion 10 further includes a slot 16 which communicates with the circular opening 13 to facilitate attachment to the bat as with a snapping action. It will be seen that a flexible or resilient material may be used to fabricate the region 17 adjacent the slot 16 as this will allow the region 17 to bend or give a sufficient distance to permit the first body portion 10 to be snapped into place around the bat.

The first body portion further includes a rim or lip 20 having an arcuate cutaway region 22. It will be seen that this cutaway region 22 provides the necessary clearance between the first body portion 10 and the hands and wrists. This clearance is usually needed to permit the batter to take a full swing with follow through.

Figure 3:
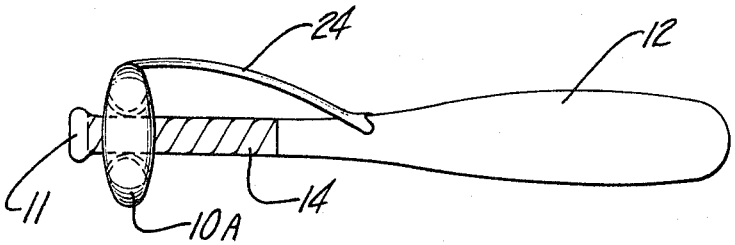
FIG. 3 is a side view of an alternative embodiment of the invention.

While the cup-shaped first body portion 10 is presently preferred, it will be understood that other configurations are possible, such as a disc or torus shaped portion 10A, as shown in FIG. 3. The disc or torus shaped portion 10A may be attached to the bat, for example, by stretching it elastically over the knob 11. In this embodiment, a cutaway region comparable to cutaway region 22 of the first embodiment may not be needed.

The invention further comprises an elongated second body portion or strap 24 which is attached to or made as an integral part of the first body portion 10. The strap 24 is preferably attached at the rim 20 of the first embodiment, or to the circumference of the torus shaped portion 10A of the alternative embodiment. In the former case the strap 24 is attached at a point on the circumference of the rim 20 generally opposite the cutaway region 22. The strap 24 is constructed of a rigid material and is adapted to shield the hands by spanning the grip portion 14 of the bat.

In addition to attaching the the first body portion 10, the strap may also be provided with a means for attaching its distal end 25 to the bat. This means for attachment may be, for example, a clasp 26 adapted to snap around the bat.

It will further be appreciated that the first body portion 10, together with the strap 24, and clasp 26 may be of a unitized construction, such as molded out of a resilient, non-brittle plastic known to be useful in the manufacture of other protective sporting equipment, such as face masks, shoulder pads and the like.

Furthermore, it will be appreciated that while the presently preferred embodiments of the invention have been described, the foregoing is not to be construed as in any way limiting the scope of the following claims.

I claim:

1. A protective device for the hands and wrists adapted to be carried on a bat having a knob and grip portion comprising, a first body portion adapted for attachment to said grip portion adjacent said knob and having a rim, an elongated second body portion disposed on said first body portion and adapted to shield the hands when grasping said grip, wherein said rim defines a cut away region opposite the position at which said second body portion is disposed on said first body portion and adapted to provide clearance for the wrists while swinging said bat.

2. A protective device for the hands and wrists adapted to be carried on a bat having a knob and grip portion comprising, a first body portion adapted for attachment to said grip portion adjacent said knob, and elongated second body portion disposed on said first body portion and adapted to shield the hands when grasping said grip, wherein said first body portion is generally paraboloidal-shaped and has a rim, and wherein said second body portion is disposed on said rim, and wherein said rim defines a cut away region opposite the position at which said second body portion is disposed on said rim and adapted to provide clearance for the wrists while swinging said bat.

* * * * *